US006415828B1

(12) United States Patent
Duggal et al.

(10) Patent No.: US 6,415,828 B1
(45) Date of Patent: Jul. 9, 2002

(54) DUAL BUOY SINGLE POINT MOORING AND FLUID TRANSFER SYSTEM

(75) Inventors: Arun S. Duggal; Martin J. Krafft; Caspar N. Heyl; Richard H. Gunderson, all of Houston, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 09/659,495

(22) Filed: Sep. 9, 2000

Related U.S. Application Data

(60) Provisional application No. 60/221,239, filed on Jul. 27, 2000.

(51) Int. Cl.[7] ..... B65B 1/04

(52) U.S. Cl. ..... 141/387; 141/388; 141/382; 141/279

(58) Field of Search ..... 141/387, 388, 141/279, 382; 441/3, 4, 5

(56) References Cited

U.S. PATENT DOCUMENTS

| | | | | |
|---|---|---|---|---|
| 3,466,680 | A | | 9/1969 | Schirtzinger |
| 4,263,004 | A | * | 4/1981 | Joubert et al. |
| 4,279,543 | A | | 7/1981 | Remery |
| 4,423,984 | A | * | 1/1984 | Panicker et al. |
| 4,793,737 | A | * | 12/1988 | Shotbolt |
| 4,878,694 | A | * | 11/1989 | Castel |
| 5,044,297 | A | * | 9/1991 | de Baan et al. |
| 5,205,768 | A | | 4/1993 | Pollack |
| 5,288,253 | A | | 2/1994 | Urdshals et al. |
| 5,427,046 | A | | 6/1995 | Brown et al. |
| 5,505,560 | A | * | 4/1996 | Brown et al. |
| 5,639,187 | A | | 6/1997 | Mungall et al. |
| 5,885,028 | A | | 3/1999 | Blanchard et al. |
| 5,941,746 | A | | 8/1999 | Isnard et al. |
| 6,109,833 | A | * | 8/2000 | Savy |
| 6,109,989 | A | * | 8/2000 | Kelm et al. |
| 6,206,742 | B1 | * | 3/2001 | Bull et al. ..... 441/1 |

FOREIGN PATENT DOCUMENTS

| | | |
|---|---|---|
| GB | 2335723 | 5/2000 |
| WO | 97/06341 | 2/1997 |
| WO | 99/66169 | 12/1999 |
| WO | 00/21825 | 4/2000 |

* cited by examiner

*Primary Examiner*—Timothy L. Maust
*Assistant Examiner*—Khoa D. Huynh
(74) *Attorney, Agent, or Firm*—Gary L. Bush, Esq.; Andrews & Kurth - Mayor, Day, Caldwell & Keeton, L.L.P.

(57) ABSTRACT

An arrangement for providing fluid communication between an offshore hydrocarbon production and/or storage facility and an offshore loading system such as a CALM buoy is disclosed. A pipeline from a FPSO or production platform runs to a submerged flowline termination buoy which is positioned beneath and separated a short distance from a CALM buoy. The flowline termination buoy is separately anchored to the sea bed from the CALM buoy, and is at a depth below the turbulent zone of the sea. The end of the pipeline is suspended from the flowline termination buoy, and a marine hose fluidly connects the end of the pipeline to a stationary part of a fluid swivel on the CALM buoy. The arrangement isolates the end of the pipeline from fatigue inducing motions of the CALM buoy.

14 Claims, 7 Drawing Sheets

FIG. 3A
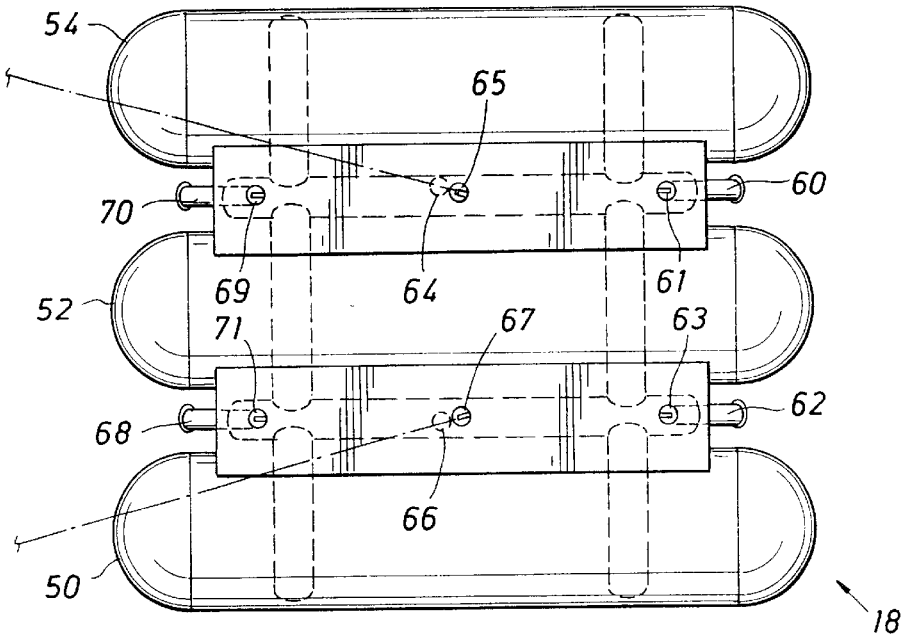
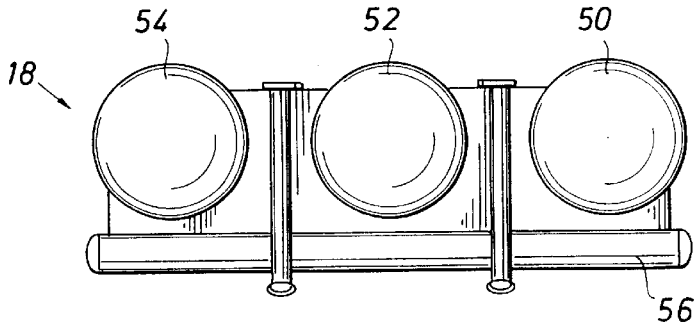
FIG. 3B
FIG. 4
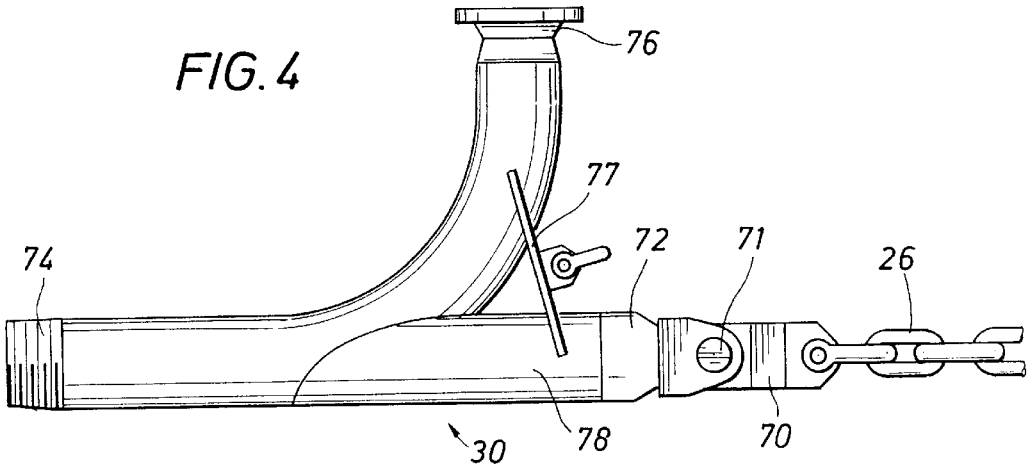

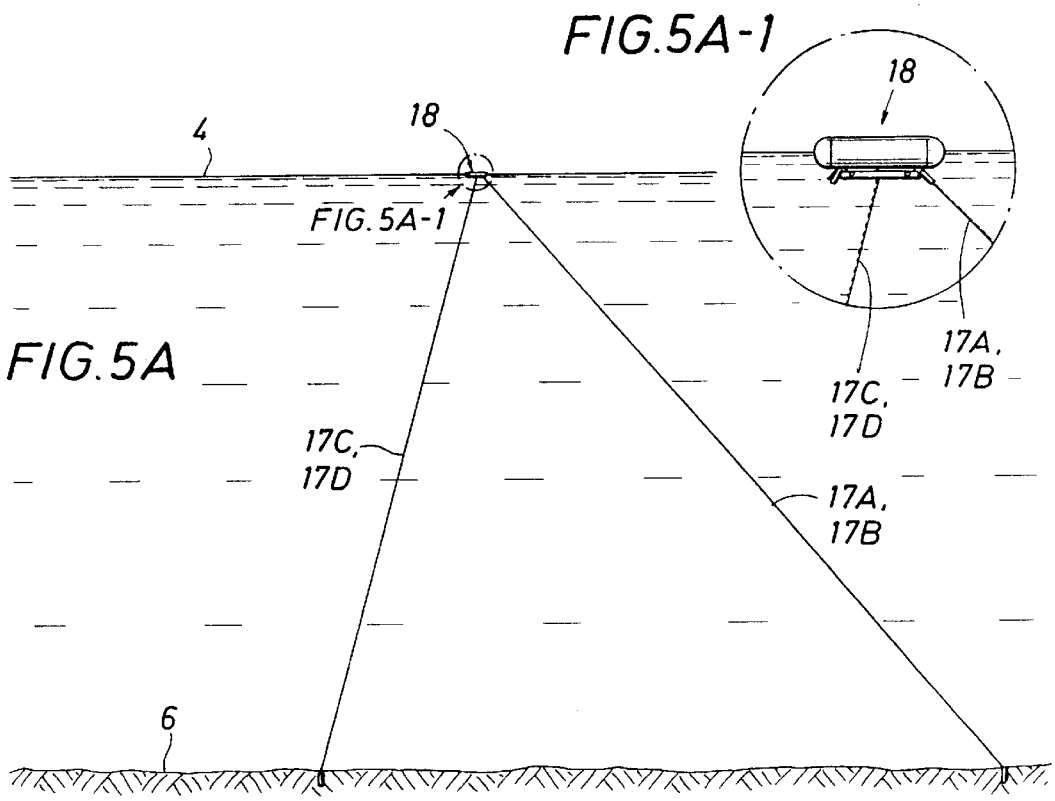
FIG.5A-1
18
4
18
FIG.5A-1
17A,
17B
17C,
17D
FIG.5A
17C,
17D
17A,
17B
6
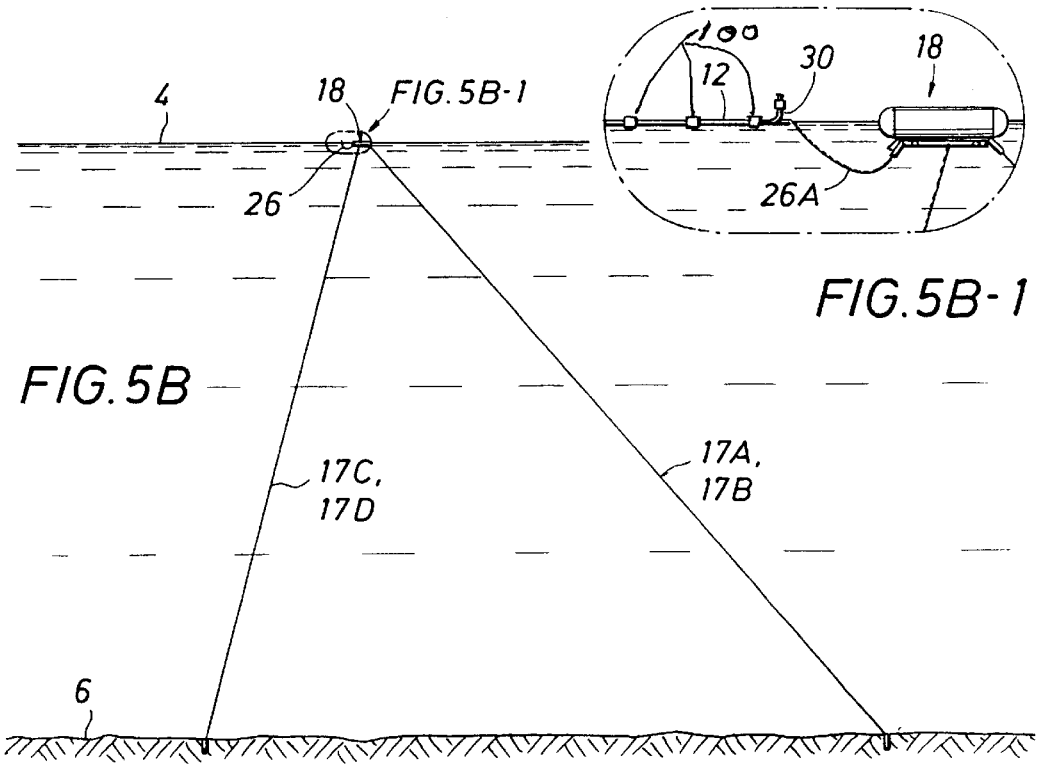
100
12
30
18
4
18
FIG.5B-1
26
26A
FIG.5B-1
FIG.5B
17C,
17D
17A,
17B
6

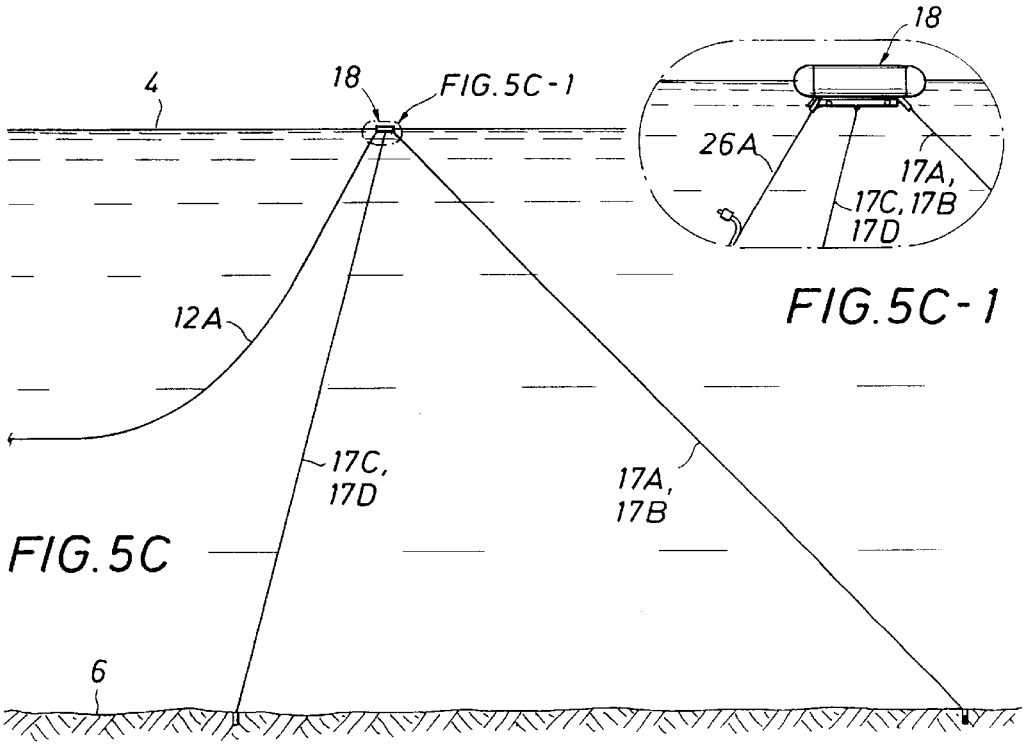
FIG.5C-1
FIG.5C
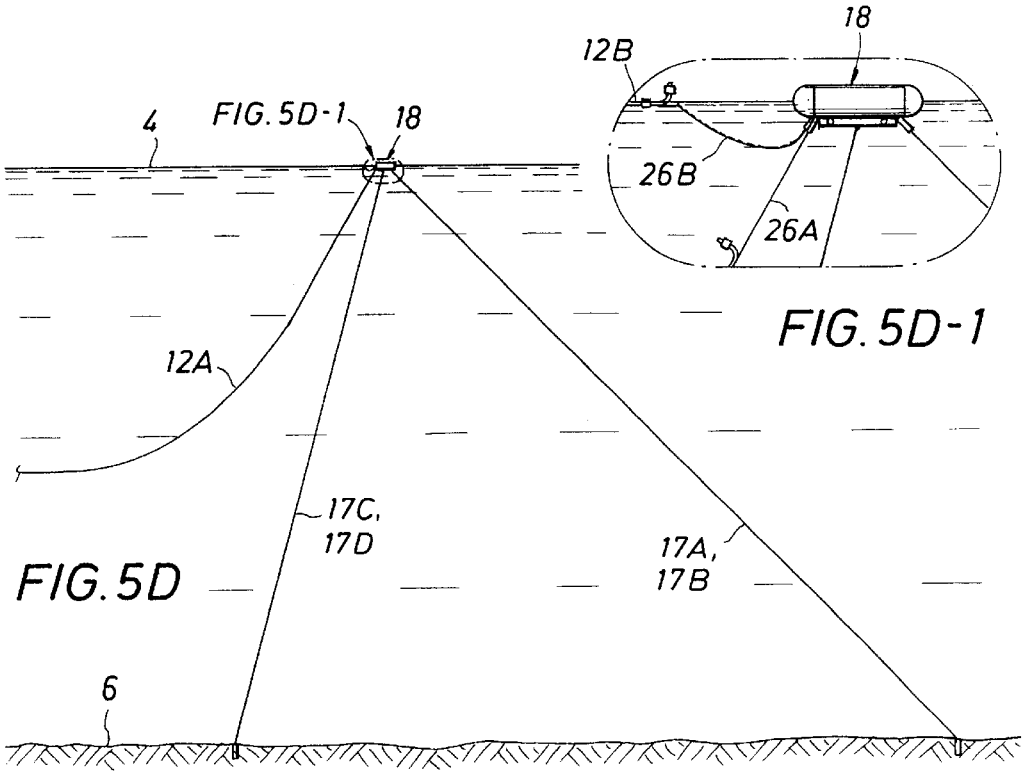
FIG.5D-1
FIG.5D

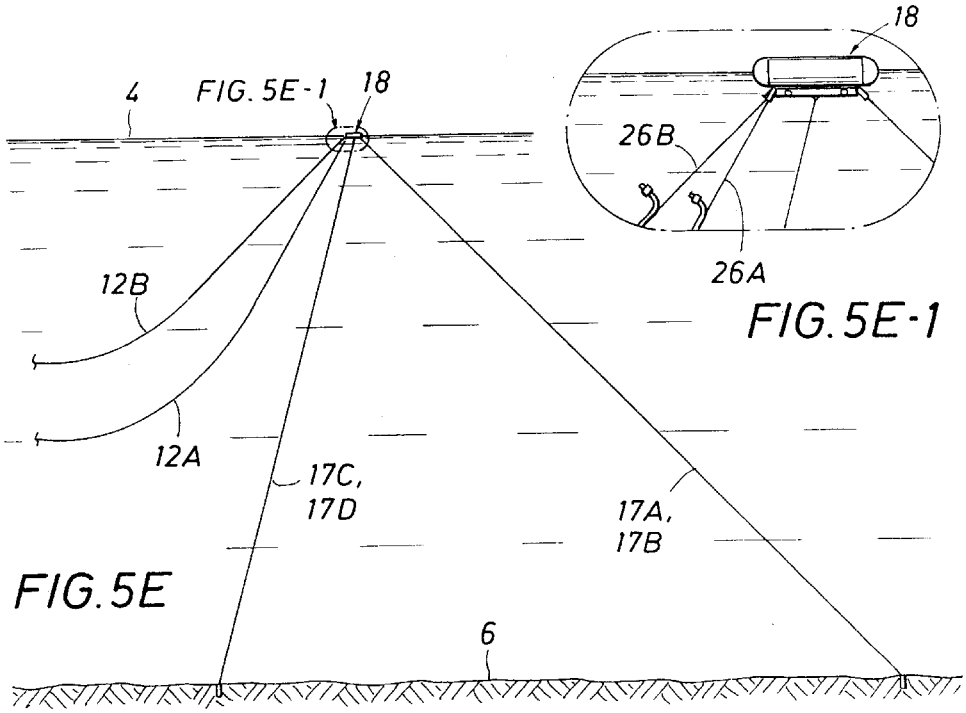
FIG. 5E-1
FIG. 5E
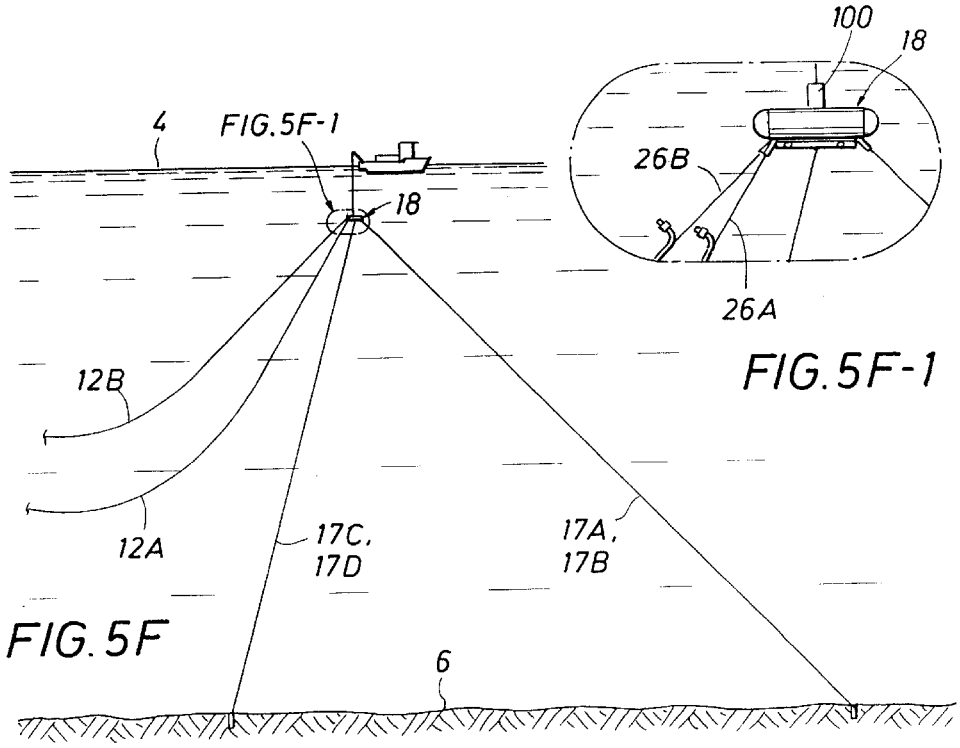
FIG. 5F-1
FIG. 5F

DUAL BUOY SINGLE POINT MOORING AND FLUID TRANSFER SYSTEM

CROSS REFERENCE TO RELATED APPLICATION

This application claims priority from U.S. Provisional Application Serial No. 60/221,239 filed on Jul. 27, 2000.

BACKGROUND OF THE INVENTION

1. Field of the Invention

This invention relates generally to an offshore loading system such as a CALM which serves as a. single point mooring (SPM) for a shuttle tanker or the like and a product transfer system for transferring hydrocarbon product via an associated product flowline arrangement between a production and/or storage facility and the SPM.

2. Description of Prior Art

In deep water operations, certain operational considerations make it desirable to offload hydrocarbons from a production and/or storage facility by running a pipeline to an offshore loading system, such as a CALM buoy, where a shuttle tanker may be moored and connected to a loading hose for filling its tanks with crude oil. Deep water installations, e.g., in depths greater than about 1000 feet, require that the pipeline be suspended between the production and/or storage facilities, such as a platform or FPSO and the CALM buoy rather than running the pipeline along the sea bed. The pipeline must be submerged at a depth deep enough so as not to interfere with shuttle tanker traffic. A problem exists in connecting the end of the pipeline directly to the CALM buoy, because as the buoy moves up and down and side to side, the end of the pipeline moves with it, and as a result is subject to fatigue failure. The term "pipeline" includes steel tubular pipelines as well as bonded and unbonded flexible flowlines fabricated of composite materials.

The problem identified above is inherent in prior offloading deep water CALM buoys which have pipelines attached directly to and supported from a CALM buoy. The pipelines are directly coupled to the CALM buoy such that motions of the CALM buoy are also directly coupled to the pipeline with resulting fatigue damage. Prior systems such as that described in U.S. Pat. No. 5,639,187 have provided a hybrid flowline including rigid (e.g., steel catenary risers) pipelines on the sea bed from subsea wells combined with flexible flowlines (e.g., marine hoses) at a submerged buoy which is moored to the sea bed by tension leg tether legs. The buoy is positioned at a depth below the turbulence zone of the water. Flexible hoses are fluidly connected to the steel catenary risers at the submerged buoy and extend upward through the turbulence zone to the surface.

Another prior system, described in British Patent GB 2335723 B, attempts to solve the problem identified above by suspending the end of a rigid steel tubular flowline (e.g., the pipeline) by a chain from the offloading buoy and fluidly connecting a flexible hose to the end of the rigid steel flowline below the turbulence zone of the sea. While eliminating a certain level of coupling of wave induced forces to the end of the rigid steel flowline which extends from a production and/or storage facility (FPSO or platform), nevertheless, a sufficient degree of coupling still exists to create a fatigue problem, and possible failure, for the pipeline.

IDENTIFICATION OF OBJECTS OF THE INVENTION

The primary object of the invention is to provide a product transfer system from a FPSO or platform via a pipeline (either rigid or flexible) to an offloading buoy and to a shuttle tanker while substantially eliminating coupling of wave induced motions of the offloading buoy with the end of the pipeline.

Another object of the invention is to provide a conventional CALM buoy for the product transfer system on which an above-water product swivel is placed so that in-situ servicing of the swivel and CALM buoy can be conducted.

Another object of the invention is to provide an offshore product transfer system that is suitable for use with large diameter, submerged, rigid (e.g., steel) or flexible (e.g., composite) pipelines in deep water.

Another object of the invention is to provide a product transfer system which decouples a submerged pipeline from a surface offloading buoy and its wave induced motions thereby reducing fatigue damage to the pipeline.

Another object of the invention is to provide a product transfer arrangement that allows for optimizing of pipeline diameter and buoyancy, because improved fatigue resistance allows for greater variability in the configuration of the submerged pipeline.

Another object of the invention is to provide a method for offshore installation of the product transfer system in staged steps for the pipeline hoses, the Flowline Termination Buoy, and the surface offloading buoy.

Another object of the invention is to provide a product transfer arrangement in which the surface offloading buoy can be replaced or repaired easily without disturbing the pipeline from the FPSO or platform with a resulting increase in overall system reliability.

Another object of the invention is to provide a product transfer system that meets the objects described above while employing a conventional surface offloading mooring and hydrocarbon transfer terminal.

SUMMARY OF THE INVENTION

The objects identified above along with other advantages and features are provided in the invention embodied in a product transfer system by which a rigid or flexible pipeline from a FPSO or platform or the like extends in the sea above the sea bed for about a nautical mile where it terminates close to a CALM buoy, and where it is fluidly coupled to a flexible hose at a Flowline Termination Buoy (FTB) which is positioned by anchor legs below the wave kinematic zone. The other end of the flexible hose is coupled to the piping leading to the stationary inlet of a product swivel mounted on a stationary portion of a single point mooring offloading buoy such as a CALM. A shuttle tanker is moored to the CALM buoy by a hawser secured to a rotatable portion of the CALM buoy. A hose from the rotatable output of the product swivel extends to the shuttle tanker to complete the product flow path from the (FPSO or platform) to the shuttle tanker.

BRIEF DESCRIPTION OF THE DRAWINGS

The objects, advantages and features of the invention will become more apparent by reference to the drawings which are appended hereto and wherein an illustrative embodiment of the invention is shown, of which:

FIG. 3A (top view) and FIG. 3B (end view) illustrate a preferred embodiment of the Flowline Termination Buoy of the invention;

FIG. 4 illustrates a gooseneck connector, adapted for suspension by a chain from the Flowline Termination Buoy for connection between the end of the pipeline and the end of the flexible hose; and FIGS. 5A–5H and enlarged illustrations of FIGS. 5A-1 to 5F-1 illustrate installation steps of the Flowline Termination Buoy with the pipeline and final connection to an offloading buoy.

DETAILED DESCRIPTION OF THE INVENTION

The double buoy offloading arrangement of this invention is for deep water hydrocarbon offloading from offshore production platforms either fixed (e.g., Jacket structures), or floating (e.g., FPSOs, Semi-submersibles, or Spars). Conventional offloading arrangements provide a single offloading buoy located approximately 2 kilometers away from the platform, with a submerged flexible or steel pipeline(s) connected between them. With the prior arrangement, the surface offloading buoy requires a large displacement to support the submerged pipeline(s) and their product. Because of its size, the offloading buoy is subject to motions in response to the wave environment. These wave-frequency motions are coupled to the pipeline and affect its dynamic response, leading to fatigue damage to the pipeline over time.

The double buoy concept of this invention effectively eliminates the fatigue damage to one or more pipelines by decoupling the motion of the surface offloading buoy from the pipelines. This is accomplished by using a Flowline Termination Buoy (FTB) submerged beneath the sea surface (on the order of 50–125 meters). The FTB is independently moored and supports the pipeline. Because the FTB is effectively out of the range of the wave kinematics, it does not exhibit significant response to the wave field, thus reducing the fatigue damage to the pipeline. Offloading to shuttle tankers is performed through a conventionally sized CALM buoy system with its own anchor leg system. Standard marine hoses or flexible flowlines connect the CALM buoy to the pipelines supported by the FTB.

Figure 1:
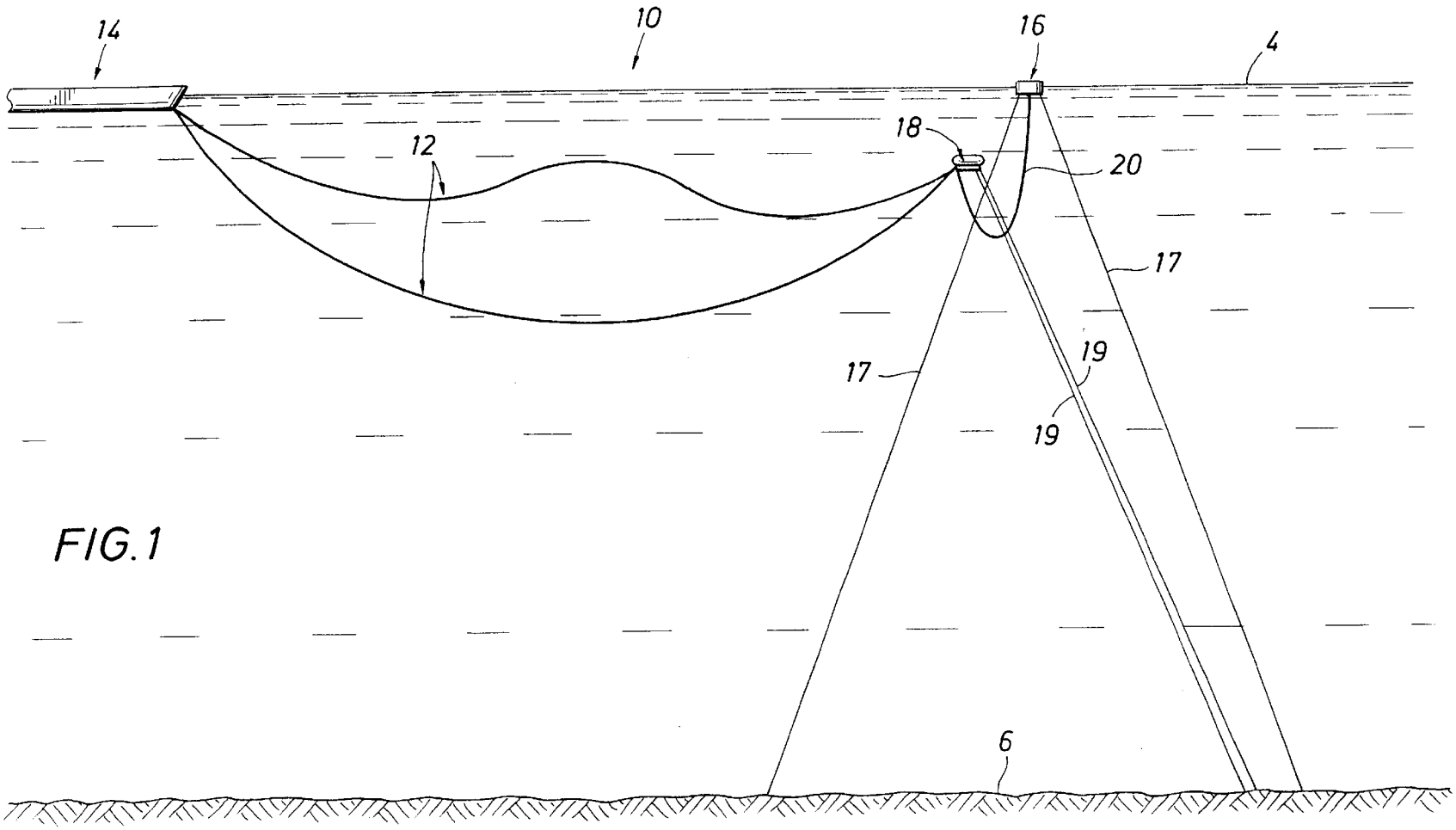
FIG. 1 is a schematic illustration of an arrangement of the invention where an end of a rigid or flexible pipeline from a FPSO or production platform is supported by a tethered submerged Flowline Termination Buoy (FTB) with a flexible marine hose fluidly connected between the end of the pipeline and a stationary inlet of a product swivel mounted on a deepwater CALM buoy.

FIG. 1 shows the general arrangement 10 of the invention where one or more pipelines 12 are fluidly connected between a FPSO or platform 14 to a deepwater CALM buoy 16 via a Flowline Termination Buoy 18 (hereafter referred to as "FTB"). The pipelines may have buoyancy modules attached along the run of the pipeline and may achieve different depth profiles (as suggested by the illustration of FIG. 1) as a function of distance from the FPSO, if desired. Marine hoses or flexible flowlines 20 are fluidly connected to the pipelines at the FTB 18 and to the product swivel of CALM buoy 16. Mooring legs 17 couple the CALM buoy 16 at the sea surface 4 to the sea floor 6. The submerged FTB 18 is coupled to the seabed by anchor legs 19. The anchor legs 19 are preferably taut, but not necessarily so, depending upon design considerations.

The pipelines 12, preferably steel tubular members which have flotation attached to them along their path from FPSO 14 to the FTB 18 to prevent excessive sagging due to their heavy weight, do not touch the sea floor. The pipelines may be steel tubular members which are joined end to end by welding as is known in the art of pipeline construction. Alternatively, the pipeline may be fabricated with composite materials. They typically run at least one nautical mile to the vicinity of the CALM offloading buoy 16, but are submerged beneath the sea surface 4 at a depth so that shuttle tankers can maneuver between the FPSO 14 and the CALM buoy 16 without fear of fouling the pipelines 12. Steel pipelines are rigid in the sense that they are continuous steel tubular members, but of course such a steel pipeline has flexibility due to their great weight and the inherent flexibility of a long spaghetti-like steel tubular string. Although the FTB 18 is shown positioned between the FPSO 14 and the CALM 16 as in FIG. 1, it may be positioned to the far side of CALM buoy 16 as shown in FIG. 2.

Figure 2:
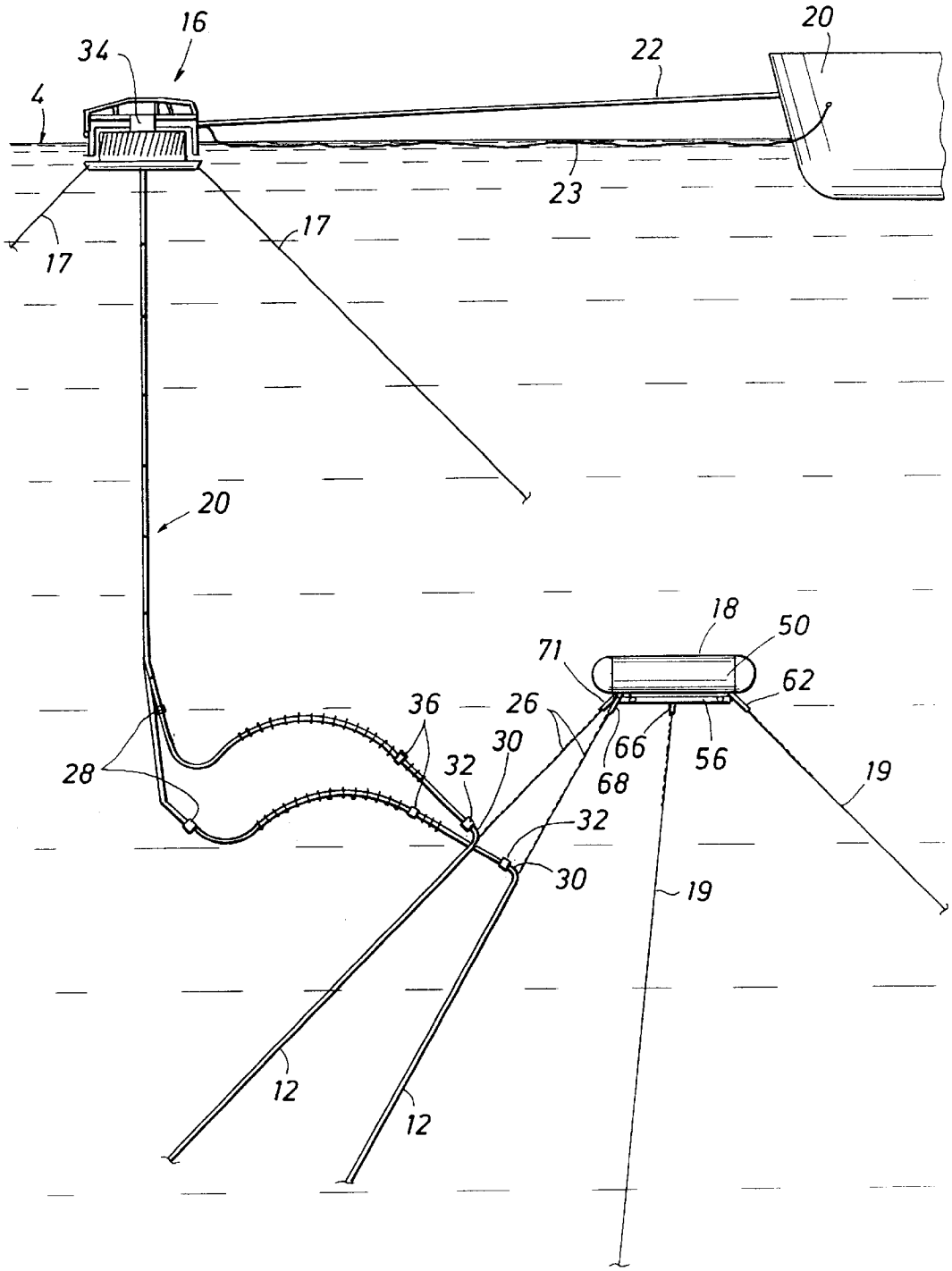
FIG. 2 is a schematic illustration showing more detail of the suspension of the rigid or flexible pipeline with an illustration of a side view of the Flowline Termination Buoy and the fluid connection of the flexible hoses to the ends of the pipelines.

The more detailed illustration of FIG. 2 illustrates a shuttle vessel 20 moored by hawsers 22 to the rotatable part of the single point mooring (e.g. CALM) offloading buoy 16. The FTB 18 is submerged about 75 meters below the. sea surface 4 to prevent contact from tanker 20 and to reduce the wave forces on the FTB. FTB 18 is anchored by four anchor legs 19. The centerline of the FTB 18 is about 80 meters from the centerline of the offloading buoy 16.

The ends of pipeline 12 are terminated by gooseneck members 30 (see more detail in FIG. 4) which are suspended from FTB 18 by chains 26. Wire or synthetic rope may be substituted for chains 26 as a suspension member. Alternatively, the ends of pipelines 12 may be attached directly to the FTB without the use of a suspending member. The attachment may be a rigid or elastic support. (This alternative direct connection is not illustrated.) In the preferred embodiment of FIG. 2, the flexible hoses 20 are connected between the goosenecks 30 and a stationary portion of a product swivel mounted on the stationary portion of CALM buoy 34. One or more loading hoses 23 extend from the rotatable portion of product swivel 34 to vessel 20. Clump weights 28 positioned on hoses 20 as illustrated in FIG. 2 provide for near-vertical entry of hoses 20 into the product swivel 34 on CALM buoy 16 with a curved section between clump weights 28 and gooseneck connections 32 providing further isolation of forces to the ends of pipelines 12 from wave, wind, and current induced motions of CALM buoy. Ball valves 30 and double closure breakaway couplings 36 provide for prevention of hydrocarbon spilling into the sea in case of repair or emergency disconnection of the hoses 20 from the pipeline 12.

FIG. 3A (top view) and FIG. 3B (side view) show that a preferred embodiment of the FTB 18 includes three buoyancy tanks 50, 52, 54 mounted on a frame 56. A side elevation of the FTB is shown in FIG. 2. Four anchor legs 19 are connected to frame 56 via conductors 60, 62, 64, 66 and chain stoppers 61, 63, 65, 67. Suspending chains 26 are connected between the seabed and FTB 18 via chain conductor 70, 68 and chain stoppers 69, 71.

FIG. 4 illustrates gooseneck member 30 (one for each pipeline hose connection) to which a chain 26 is connected via a link 70 secured to a clevis 72 by a pin 71. The ends of pipeline 12 are fluidly connected to inlet end 74. The lower end of each hose 20 is connected to outlet end 76. An extension member 78, secured to the inlet section of gooseneck 30, is connected to clevis 72. A cross member 77 and shackle provides for handling of gooseneck member 30 during installation.

METHOD OF INSTALLATION

The preferred method for installing the arrangement of FIG. 1 includes providing FTB 18 (as shown in FIG. 5A) at a sea surface location and installing anchor legs 17A and 17B and adjusting their length to a final position in chain stoppers 61, 63. The anchor chains 17C, 17D are connected to the FTB 18 with a length of additional installation chain connected to the top portion of the chain. A length of 100 meters of additional installation chain may be provided depending on the site. In this condition the FTB remains at the water surface 4.

Figure 5G:
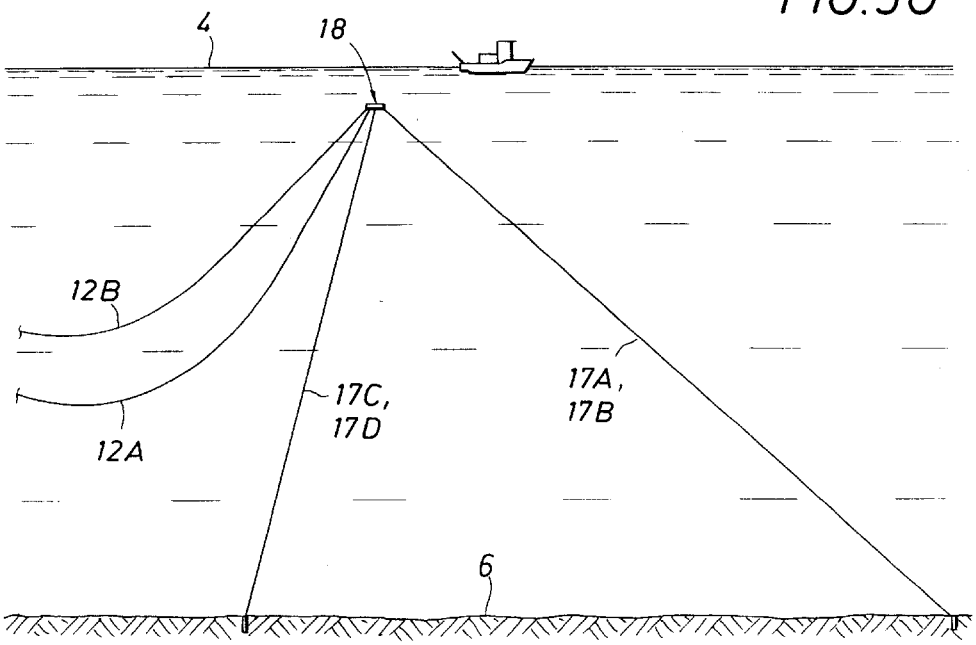

Next, a pipeline 12 is provided in one of two alternative ways. The pipeline 12 can be fabricated at an onshore location and towed to the FTB so that it extends from the hydrocarbon facility 14 to the FTB 18. Alternatively, the pipeline 12 may be assembled in place at sea by J-laying or S-laying processes starting from the FTB 18 and running to the hydrocarbon facility 14. A single pipeline 12 may be provided as illustrated in FIGS. 5A, 5B, but two or more pipelines 12A, 12B may be provided as illustrated in FIGS. 5E–5H.

As shown in FIG. 5B, a first pipeline suspending chain 26A is installed via FTB conductor 68 and chain stopper 71 to a desired length and is attached to gooseneck 30 at the end of a pipeline 12 which has buoyancy elements 100 added to it so that it floats on the sea surface 4. The first pipeline 12A is connected to the FPSO or platform 14. It is flooded and excess buoyancy is removed to allow it to reach its desired suspended configuration as illustrated in FIG. 5C. The FTB 18 supports the pipeline 12A while remaining on the sea surface 4.

As shown in FIG. 5D a second pipeline 12B is connected to FTB 18 by means of a second suspending chain 26B in the same way as described above. The pipeline 12B is connected to platform 14, and when the pipeline 12B is flooded and allowed to reach its desired suspended configuration, the FTB 18 has sufficient buoyancy to remain on the surface as in FIG. 5E.

FIG. 5F indicates that a submersible chain pulling device 100 such as chain jacks, rotary drives, etc. are installed on anchor legs 17C, 17D which are used to jack the FTB down to a desired depth by controlling progress on legs 17C, 17D.

Figure 5H:
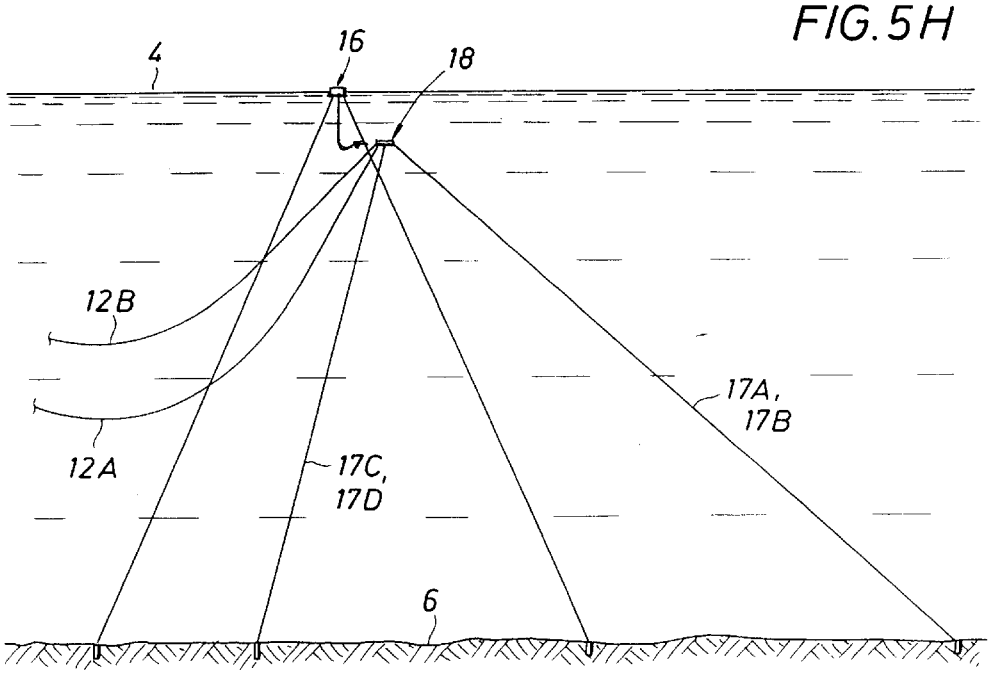

As shown in FIG. 5G, the chain pulling devices 100 and excess installation chain at the top of legs 17C, 17D are removed. Next as illustrated in FIG. 5H, this CALM buoy 16 is installed and the marine hoses 20 are installed with gooseneck connections between pipelines 12A, 12B to a product swivel of CALM buoy 16.

What is claimed is:

1. A method for suspending a pipeline in the sea between a hydrocarbon facility positioned above a sea bed and a CALM buoy comprising, providing a buoyant body at the sea surface in proximity to a desired location of said CALM buoy, providing one or more buoyancy members on said pipeline so that said pipeline is substantially at the sea surface with an outlet end adjacent said buoyant body, connecting a flexible tension member between said buoyant body and a gooseneck connection member with said outlet end of said pipeline fluidly coupled to an inlet end of said gooseneck connection member, connecting an inlet end of said pipeline to said hydrocarbon facility, adjusting said one or more buoyancy members, lowering said buoyant body to a desired submerged position, and mooring said buoyant body to said sea bed, so that said pipeline is submerged in the sea and suspended between said hydrocarbon facility and said buoyant body, mooring said CALM buoy at said desired location, fluidly connecting an inlet end of a marine hose to an outlet end of said gooseneck connection member so that said pipeline and said marine hose are fluidly coupled, and mechanically and fluidly coupling an outlet end of said marine hose to an inlet end of a product swivel mounted on said CALM buoy.

2. The method of claim 1, wherein said step of mooring said buoyant body to said sea bed includes the step of tautly anchoring said buoyant body to said sea bed with flexible tension members.

3. The method of claim 1, wherein said pipeline is run in a direction from said hydrocarbon facility to said desired location of said CALM buoy.

4. The method of claim 1, wherein said pipeline is run in a direction from said CALM buoy to said hydrocarbon facility.

5. The method of claim 1, wherein said hydrocarbon facility is a FPSO.

6. The method of claim 1, wherein said hydrocarbon facility is a production platform.

7. An offshore arrangement comprising, a hydrocarbon facility disposed above a seabed, a CALM buoy having a product swivel disposed thereon, said CALM buoy being arranged and designed for mooring a tanker thereto and transferring hydrocarbon product from said swivel to a moored tanker, a submerged flowline termination buoy positioned in proximity to said CALM buoy, said flowline termination buoy being coupled to the seabed by mooring legs, a flexible tension member having first and second ends, with said first end of said flexible tension member connected to said flowline termination buoy, and with a second end of said flexible tension member connected to a gooseneck connection member at a position above said seabed, a pipeline with first and second pipeline ends, with said pipeline extending in the sea without contact to the seabed, said pipeline having the first pipeline end coupled to said hydrocarbon facility and the second pipeline end coupled to an input end of said gooseneck connection member, and a marine hose with first and second hose ends, with said first hose end fluidly coupled to said second pipeline end via an output end of said gooseneck connection member and a second hose end fluidly coupled to said product swivel on said CALM buoy.

8. The offshore arrangement of claim 7 wherein, said hydrocarbon facility is a floating storage production and offloading vessel.

9. The offshore arrangement of claim 7 wherein said hydrocarbon facility is a deepwater production platform.

10. The offshore arrangement of claim 7 wherein, said submerged flowline termination buoy includes a frame and at least one buoyancy tank mounted thereon.

11. The offshore arrangement of claim 10 further including, mooring chain conductors and chain stoppers mounted on said frame which are arranged and designed for connecting said mooring legs to said submerged flowline termination buoy, and suspending member chain conductor and chain stoppers mounted on said frame which are arranged and designed for connecting said suspending member to said submerged flowline termination buoy.

12. The offshore arrangement of claim 7 wherein, said flexible tension member is a chain.

13. The offshore arrangement of claim 7 wherein, said flexible tension member is a wire.

14. The offshore arrangement of claim 7 wherein, said flexible tension member is a synthetic rope.

* * * * *